United States Patent [19]

Yamada et al.

[11] Patent Number: 4,802,891

[45] Date of Patent: Feb. 7, 1989

[54] COAL-METHANOL SLURRY AND ITS PRODUCTION PROCESS

[75] Inventors: Izumi Yamada, Tokyo; Tetsuya Oishi, Kamakura; Kazuhiko Hanashita, Kitakyushu, all of Japan

[73] Assignees: Mitsui Mining Company, Limited; Mitsui Toatsu Chemicals, Incorporated, both of Tokyo, Japan

[21] Appl. No.: 171,152

[22] Filed: Mar. 21, 1988

Related U.S. Application Data

[63] Continuation of Ser. No. 861,439, May 9, 1986, abandoned.

[30] Foreign Application Priority Data

Apr. 15, 1986 [JP] Japan ..... 61-85073

[51] Int. Cl.[4] ..... C10L 1/32

[52] U.S. Cl. ..... 44/51; 44/53

[58] Field of Search ..... 44/51, 53

[56] References Cited

U.S. PATENT DOCUMENTS

| | | | |
|---|---|---|---|
| 1,623,241 | 4/1927 | Greenstreet | 44/51 |
| 1,681,335 | 8/1928 | Griessbach et al. | 44/51 |
| 4,045,092 | 8/1977 | Keller | 44/51 |
| 4,282,006 | 8/1981 | Funk | 44/51 |
| 4,416,666 | 11/1983 | Funk | 44/51 |
| 4,441,887 | 4/1984 | Funk | 44/51 |
| 4,479,806 | 10/1984 | Funk | 44/51 |
| 4,498,906 | 2/1985 | Scheffee | 44/51 |
| 4,501,205 | 2/1985 | Funk | 44/51 |

FOREIGN PATENT DOCUMENTS

| | | | |
|---|---|---|---|
| 60-0081293 | 5/1985 | Japan | 44/51 |

OTHER PUBLICATIONS

J58045283-A (8317), 1983, Japanese Abstract.
J58501183w (8335), 1983, Japanese Abstract.
J53055304a (7826), 1978, Japanese Abstract.

*Primary Examiner*—William R. Dixon, Jr.
*Assistant Examiner*—Margaret B. Medley
*Attorney, Agent, or Firm*—Oblon, Fisher, Spivak, McClelland & Maier

[57] ABSTRACT

A coal-methanol slurry having excellent storage stability, transportability and combustibility has been provided by using coal particles having a maximum particle size not greater than 1,500 μm and a cumulative particle size distribution specified with respective to particles of 74 μm and smaller, 10 μm and smaller and 3 μm and smaller and controlling the concentration of the coal particles within a specific range defined in relation to the degree of carbonization of the coal employed. A useful and advantageous production process of the slurry has also been provided, featuring an addition of water and the timing of its addition.

6 Claims, No Drawings

COAL-METHANOL SLURRY AND ITS PRODUCTION PROCESS

This application is a continuation of application Ser. No. 861,439, filed on May 9, 1986, now abandoned.

BACKGROUND OF THE INVENTION (1) Field of the Invention

This invention relates to a coal-methanol slurry having excellent storage stability, transportability and combustibility and a process for the production of the slurry.

(2) Description of the Prior Art

People are more and more concerned these days with the exhaustibility of petroleum resources which have been used widely as energy sources. Coal has thus started attracting people's attention back as a substitute for petroleum. As a solid fuel, coal is however accompanied by inherent and unavoidable disadvantages in transportation and handling compared with liquid fues.

As a method for solving this problem, it is attempted to pulverize coal and then mix it with a medium such as mineral oil or water, in other words, to convert coal into a slurry fuel. Mineral oil, water, methanol and the like have been primarily investigated as media for use in the practice of this method. These different media have brought about different characteristic features.

Among resulting slurry fuels, coal-methanol slurry (hereinafter abbreviated as "CMS" for the sake of brevity) has such advantages as will be described below and methanol has hence drawn interests as a medium for the fluidization of coal.

Methanol can now be produced from a wide variety of different raw materials. CMS may be economically produced from coal only, provided that an economical synthesis route making use of coal gasification can be developed for methanol in the future. Use of methanol as a medium makes it possible to cut down the transportation cost per unit energy compared with aqueous slurry. Since the freezing point of methanol is low (−98° C.), there is no danger for CMS to freeze even in cold districts. This CMS method can be applied even to low-grade coal which contains lots of water, involves the danger of spontaneous combustion depending on its type and is not used widely at present. At a certain suitable location along the transportation route of CMS or at a place of consumption of CMS, a portion of methanol may be separated and then reused as a transportation medium or as methanol for various applications such as a fuel and a raw material for the chemical industry.

As a prior art technique for CMS, the process disclosed in Japanese Patent Laid-Ooen No. 55304/1978 has been known. In this prior art process, coal is ground until most of its particles are reduced to 100 mesh or smaller. The resultant particles are mixed with methanol to obtain a methanol-pulverized coal suspension. This suspension is pseudo-thixotropic, and can maintain its suspended state provided that it is gently stirred during its storage. It can retain its suspended state without allowing its components to separate out even when it is pumped through a pipeline, namely, has shear thinning rheology. It can therefore be pumped for its transportation at an apparent viscosity lower than its viscosity at standstill. When it is stored without stirring, a part of the suspended pulverized coal precipitates on the bottom of its storage vessel and forms a hard coal layer, namely, a so-called compact layer. Once this compact layer is formed, it is difficult to bring the suspension back into the original uniform suspension. The above suspension is thus not considered to have sufficient transportability and storage stability.

Japanese Patent Laid-Open No. 45283/1983 discloses a process featuring an addition of water in a suitable amount to obtain CMS which is less susceptible to compact layer formation and has good storage stability. This process is however still insufficient as to improvements to the transportability.

In general, the quality of coal slurry is evaluated by characteristic properties such as stability (storability), viscosity (transportability), combustibility, etc.

As parameters governing these characteristicproperties in CMS, may be mentioned the type of the coal, the concentration of the coal in the slurry, the particle size distribution and water content of the coal, and additives. The quality of CMS is determined by these parameters along with certain production conditions such as ginding and mixing. These parameters however give influence to one another and act in a complex manner. It is therefore not easy to find out a combination of suitable conditions for the respective parameters. In conventional processes, no sufficient investigation has been made on this point. In order to obtain CMS of good quality stably from various types of coal, it has hence been required to find out optimum conditions for the respective parameters whenever the coal is changed from one type to another.

Regarding the particle size distribution of coal in coal slurry, a great deal of work has been made on coal-water slurry (hereinafter abbreviated as "CWS" for the sake of brevity), including for example Japanese Patent Disclosure No. 501183/1983. However, there is no report on the same subject matter investigated on CMS. In the case of CWS, the compatibility between coal and water is generally low and no interaction is usually allowed to take place therebetween. Hence, its analysis is relatively easy. In the case of CMS, -large miscibility exists between coal and methanol. Some components of the coal are partly eluted in the methanol, developing such complex interaction that the compositions of both solid and liquid components in CMS are modified and the methanol penetrates into pores and cracks in the coal to facilitate the disintegration of the coal. As has been mentioned above, CMS shows different behavior from CWS. Turning next to their combustion, different from coal particles in CWS in which water is hard to penetrate in coal and has no combustibility, coal particles in CMS are allowed to burn while being disintegrated into particles owing to their deflagration by expansion and combustion of the methanol penetrated therein.

Since CMS shows substantially different behavior from CWS as mentioned above, it is necessary to analyze parameters governing the storage stability, transport-parameters ability, combustibility and the like of CMS from a viewpoint different from that applied to CWS so that optimum conditions be established for its production.

SUMMARY OF THE INVENTION

An object of this invention is to improve the above-mentioned drawbacks of the prior art techniques and more specifically, to analyze parameters governing various characteristic properties of CMS and then to establish optimum conditions for the parameters, thereby providing CMS having excellent storage stability, transportability and combustion properties.

Another object of this invention is to provide a process suitable for use in the production of such excellent CMS.

In one aspect of this invention, there is thus provided a coal-methanol slurry of coal particles and methanol as principal components, wherein the coal particles have a maximum particle size not greater than 1,500 μm and a cumulative particle size distribution of 30–65 wt. % of 74 μm and smaller particles, 10–25 wt. % of 10 μm and smaller particles and 5–15 wt. % of 3 μm and smaller particles, and the concentration of the coal particles falls within a range satisfying the following equation (a):

$$X-34.0 \leqq Y \leqq X-15.1 \quad (a)$$

wherein X means the degree of coalification expressed in terms of wt. % of carbon in the coal particles and Y denotes the concentration (wt. %) of the coal particles in the slurry.

In the coal-methanol slurry of this invention, it is preferred that it contains 0.5–25 wt. % or more preferably 0.5–20 wt. % of water in addition to theinherent moisture of the coal with a proviso that the total water content of the slurry does not exceed 30 wt. %.

In another aspect of this invention, there is also provided a process for producing a coal-methanol slurry, which comprises:

(a) dry- or wet-grinding coal to coal particles having a maximum particle size not greater than 1,500 μm and a cumulative particle size distribution of 30–65 wt. % of 74 μm and smaller particles, 10–25 wt. % of 10 μm and smaller particles and 5–15 wt. % of 3 μm and smaller particles;

(b) adding, to the coal particles, at least a portion of water in an amount sufficient to achieve a total water content of the inherent moisture of the coal plus at least 0.5 wt. % in the coal-methanol slurry to be obtained at the end of the process, and mixing the resultant coal-water mixture; and (c) adding methanol and any remaining portion of the water to the thus-obtained coal-water mixture so as to control the total water content in the slurry below 30 wt. % and within a range of the inherent moisture of the coal plus 0.5–25.0 wt. % and to have the concentration of the coal particles in the coal-methanol slurry satisfy the following equation (a):

$$X-34.0 \leqq Y \leqq X-15.1 \quad (a)$$

wherein X means the degree of coalification expressed in terms of wt. % of carbon in the coal particles and Y denotes the concentration (wt. %) of the coal particles in the slurry, followed by mixing of the resultant water-containing coal-methanol mixture.

The above-described CMS of this invention has excellent storage sability of 2 months or longer in terms of refluidable maximum standstill period, which will be described later, and superb transportability as demonstrated by a viscosity of 50–1,000 cps. In spite of abundant inclusion of coarse particles, it is a fluidized coal fuel of such high quality that a combustion efficiency equal to or greater than that available from the combustion of pulverized coal can be achieved. Moreover, it can be produced through relatively simple steps. It is effective for the enrichment of coal. It also permits with ease the use of low-grade coal. Accordingly, it is also advantageous from the economical viewpoint and hence has extremely high practical utility.

DETAILED DESCRIPTION OF THE PREFERRED EMBODIMENTS OF THE INVENTION

As mentioned above, the quality of each CMS is evaluated primarily by its stability (storability)-, viscosity (transportability) and combustibility. The present inventors conducted various investigations as to conditions for the production of CMS, on which various parameters governing these properties were studied in detail both individually and in combination. As a result, each of the parameters was found to give complex influence to the quality of CMS. Upon establishment of optimum conditions, a number of experiments were hence required. However, a description will next be made of each parameter while holding the remaining parameters constant in order to facilitate the understanding of the present invention.

As a result of our investigations, the following tendency was observed. As the proportion of finer coal particles increases in a CMS, its stability and combustibility increase but its transportability is lowered due to increased viscosity. The stability is improved as the concentration of coal increases. Its viscosity however increases if the concentration of coal is too high. Placing importance on the practical utility and economy of CMS, the present inventors took the production easiness, storability and transportability, calorific value and combustibility into parallel consideration. As a result, the following target properties were established for practically-usable CMS:

Stability: 2 months or longer in terms of refluidable maximum standstill period.

Viscosity: 50–1,000 cps (centipoises).

Combustibility: Equal to or greater than pulverized coal as a single fuel.

According to the finding of the present inventors, physical properties of CMS are dependent heavily on the particle size distribution of coal in the slurry. Superfine particles have been found to give considerable influence especially to the stability and viscosity of CMS. Namely, it is desirable to increase the proportion of finer coal particles as much as possible from the viewpoints of stability, the readiness in resuming conveyance through a pipeline, the wearing of pipes and combustibility. On the other hand, it is preferable to increase the proportion of coarser coal particles from the viewpoints of viscosity reduction for facilitating its conveyance through a pipeline, the production of CMS with a higher concentration, and the saving of grinding power. In order to obtain a CMS having practical utility, it is therefore necessary to determine a specific range of particle size distribution while taking these correlations and economy into parallel consideration.

The present inventors prepared CMS samples having various particle size distributions. Their physical properties were then evaluated. As a result, it has been found that a CMS having excellent storage stability, low viscosity and good combustibility can be obtained by controlling the overall particle size distribution, maximum particle size and the content of superfine particles. Although the optimum particle size distribution for CMS varies depending on the type of each coal as the starting material and its grinding method, a CMS having such good quality that its properties fall respectively within the above-mentioned acceptable ranges can be obtained provided that the maximum particle size of its coal particles and the content ranges of 74 μm and smaller particles, 10 μm and smaller particles and 3 μm and smaller particles are specified as described above. Particle sizes are also important from the viewpoint of combustibility. In order to achieve a combustion efficiency of 95% or higher by burning pulverized coal or CWS as a single fuel in a boiler furnace, it has been said that coal must be pulverized to until 74 μm and smaller particles amount to 70–80% of the coal. In the case of CMS, the coal is allowed to burn while being deflagrated owing to the effects of the methanol penetrated in the coal particles. As far as its combustibility is concerned, it is sufficient to perform the pulverization until 74 μm and smaller particles amount to 40–50%, and the maximum particle size is permissible up to 1,500 μm. However, CMS has higher viscosity and hence poor fluidity when obtained from coal particles in which the proportion of 74 μm and smaller particles exceeds 65 wt. %. On the other hand, CMS obtained from coal particles which contain less than 30 wt. % of 74 μm and smaller particles is generally low in viscosity but is prone to sedimentation of coal particles and is thus poor in stability. It is therefore impractical. Even if the proportion of coal particles of 74 μm and smaller falls within the range of 30–65 wt. %, the resultant CMS is accompanied by similar inconvenience and is hence impractical, for example, if the proportion of coal particles of 3 μm and smaller does not reach 5 wt. % or exceeds 15 wt. %.

For the production of the CMS of this invention, a wide variety of coal ranging from lignite to anthracite may be used. Even among CMSs produced under the same conditions, their properties may vary significantly in accordance with their starting coal materials. According to the finding of the present inventor, the type of coal gives considerable influence to the viscosity of a slurry to be obtained. In this respect, it is necessary to control especially the value of the above-mentioned Y.

As mentioned above, the slurry viscosity is required to fall within the range of 50–1,000 cps for practical CMS. In order to achieve such a viscosity range stably, it is necessary to control the value Y in terms of the degree of coalification of coal to b used. The relationship between the degree of coalification and viscosity is now specifically described. When Canadian bituminous coal is used by way of example, the value Y ranges from 73.6–54.7 wt. % if it is calculated by using a typical degree of coalification of 88.7. When U.S. sub-bituminous coal is employed on the other hand, the value Y ranges from 1.6–42.7 wt. % if it is calculated by using 76.7 as the degree of coalification. In the former case, a CMS slurry having a coal concentration of 73.6 wt. % has a viscosity of about 1,000 cps. Similarly, in the latter case, a CMS slurry having a coal concentration of 61.6 wt. % has a viscosity of about 1,000 cps. These concentrations therefore indicate approximately the upper limit of usable concentrations. If the lower limit of the value Y is not reached, the stability of the slurry is lowered and at the same time, the transportation efficiency of coal is reduced so that the slurry is not usable.

In a preferred embodiment of this invention, the water content of CMS is controlled by incorporating water in addition to the inherent moisture contained in coal. The amount of the additional water may be controlled preferably within a range of 0.5–25 wt. %, more preferably 0.5–20 wt. % and most preferably 2–15 wt. %. Inclusion of water in addition to the inherent moisture of coal in a CMS is effective in improving the stability of the CMS and lowering the viscosity of the CMS. For example, the viscosity of a CMS produed from Canadian bituminous coal having an inherent moisture of 5.9 wt. % without addition of water was about 900 cps. When its water content was increased to 20 wt. % by an incorporation of additional water, its viscosity dropped to about 600 cps and at the same time, its stability was improved. It is however impractical to increase the total water content beyond 30 wt. % in CMS, because the inclusion of such excess water decreases the calorific value of CMS.

As a more effective method for lowering the slurry viscosity, the following method may be referred to. Namely, in the above-described process for the production of the water-containing CMS, the slurry viscosity can be effectively lowered by bringing the coal into contact with the additional water prior to the mixing of the coal and methanol. As to the amount of the additional water brought into contact with the coal, it is preferred to bring a portion or the whole portion of the additional water in an amount permissible to remain in the CMS into contact with the coal, followed by mixing of the resultant coal-water mixture; and then to bring any remaining water into contact with the coal-water mixture. After the above contact procedure, it is preferred to bring the coal–water mixture into contact with any still remaining water or in some instances, with a water-methanol mixture, and then with methanol or remaining methanol. If the starting coal contains too much water, it is necessary to remove extra water by centrifugation or the like to adjust the total water content.

Although it is not clear why such additional effects can be brought about by bringing coal into contact with water prior to its contact with methanol, CMS produced from coal prepared by adding and mixing water in view of the water content of the starting coal and optionally grinding the water-added starting coal can maintain low viscosity and is therefore excellent in transportability and practical utility. The above-described process is particularly effective for coal of such a type that can absorb methanol in a large amount, e.g., bituminous coal and sub-bituminous coal, because the viscosity increases in a lower coal concentration range but decreases in a higher coal concentration range.

Upon production of the CMS of this invention, its stability and fluidity can be improved further by using one or more suitable additives. As such additives, may be used anionic surfactants, cationic surfactants, non-ionic surfactants, polymeric surfactants, other organic compounds, etc. Of these, a non-ionic surfactant containing an $-(OCH_2-CH_2)_n-OH$ group as a hydrophilic group and an ether or ester bond of an aliphatic or aromatic hydrocarbon group or an ether or ester bond of an $$HO-(CH_2-\underset{\underset{CH_3}{|}}{CH}-O)_n-$$

group as a hydrophobic group shows remarkable stabilization effects. As viscosity reductants, certain water-soluble phosphoric acid salts, hydroxides such as alkali metal hydroxides, salts of mild acids, amphoteric compounds containing both cationic and anionic functional groups, anionic surfactants and the like are also effective. These additives may each be used in an amount below 5 wt. %, preferably, in a range of 0.2–2 wt. %. In Japanese Patent Application No. 188450/1983, the present inventors have already proposed, as such additives, partially-desulfonated lignosulfonic acids, which have been obtained respectively by desulfonating lignosulfonic acid and salts thereof, and salts of the partially-desulfonated lignosulfonic acids. By using one or more of these compounds, it is possible to improve the fluidity significantly without deleteriously effecting on the excellent properties of the slurry such as stability and combustibility and to increase the coal concentration to improve the efficiency of its transportation without lowering the fluidity, thereby providing a still better CMS.

The additives of the lignosulfonic acid type disclosed in the above Japanese Patent Application are useful as modifiers not only for CMSs provided in accordance with the present invention but also for other usual CMSs. They will hereinafter be described in detail.

As the above-mentioned lignosulfonic acid and salts thereof, may be used a waste cooking liquor obtained by cooking, for example, wood chips such as softwood or hardwood chips or other lignin-containing raw material in a sulfurous acid solution of a bisulfite or in some instances, that obtained by removing monosaccharides such as hexose and pentose, modified sugar products, inorganic matter and the like from the waste cooking liquor for its purification by precipitation making use of a precipitant such as acriflavine, thioflavine or lime, salting-out technique, dialysis or extraction, its salts and the like. It is however sufficient if lignosulfonic acid and/or its salt are contained as principal components. No limitation shall be imposed on lignosulfonic acid and salts thereof by the type of each lignin raw material, contents of sugar and other components, the manner of chemical treatments, etc.

The degree of sulfonation of each of the partially-desulfonated lignosulfonic acids and their salts may preferably be 0.25 equivalent or lower, notably, 0.2 equivalent or lower in terms of phenylpropne units. Useful acids and salts may include, for example, acids composed of compounds obtained by oxidizing and desulfonizing a sulfite pulp waste cooking liquor, lignosulfonic acid isolated and purified from the waste cooking liquor and/or salts thereof at elevated temperatures; compounds obtained by separating modified sugar products, inorganic matter and the like from the acids for their purification; and the like.

Compared with their untreated counterparts, these partially-desulfonated lignosulfonic acids and their salts contain carboxyl groups and phenolic hydroxyl groups at higher concentrations and on the other hand, sulfone groups and alcoholic hydroxyl groups at lower concentrations, and have much smaller molecular weights of about 30,000 or smaller. These partially-desulfonated lignosulfonic acids and their salts, especially, those having degrees of sulfonation of 0.25 equivalent or smaller in terms of phenylpropane unit have extremely good miscibility with methanol and show excellent viscosity-reducing effects for CMS. The partially-desulfonated lignosulfonic acids and their salts exhibit chemical and physical properties absolutely different from their starting lignosulfonic acid and its salts.

The above-described salts of the partially-desulfonated lignosulfonic acids are preferably monovalent, divalent or trivalent metal, ammonium or amine salts. In each of these salts, either one of its acid and base may be contained more than the other. In addition, each of the salts may be used after its formation or alternatively, its salt and base may be used separately.

As metals useful in the formation of such salts, may be mentioned lithium, sodium, potassium, magnesium, calcium, zinc, cadmium, barium, aluminum, lead, tin, copper, chromium, manganese, iron, cobalt, nickel, etc.

As amines useful in the formation of the salts, may be mentioned aliphatic amines, alicyclic amines, aromatic amines, alkanolamines, pyridine and its derivatives, compounds containing a quaternarized N atom, etc., including methylamine, ethylamine, butylamine, octylamine, laurylamine, stearylamine, oleylamine, dimethylamine, N-methyl-laurylamine, dilaurylamine, trimethylamine, N,N-dimethyllaurylamine, ethylenediamine, hexamethylenediamine, diethylenetriamine, beef tallow alkylamines, cyclohexylamine, cyclohexyldiamine, triethylenediamine, morpholine, monoethanolamine, diethanolamine, triethanolamine, monoisopropanolamine, diisopropanolamine, triisopropanolamine, aniline, p-toluidine, m-toluidine, nitroaniline, benzylamine, pyridine, phenylenediamine, benzidine, etc.

The partially-desulfonated lignosulfonic acids and their salts are compounds known to date and may be prepared by their respective known processes. They may each be obtained by charging air or oxygen under pressure into a sulfite pulp waste cooling liquor, separated and purified lignosulfonic acid or a salt thereof, for example, in the presence of an alkali such as caustic soda, at an initial pH of 9 or higher and at a temperature of 100°–300° C., preferably, 150°–250° C., thereby to induce high-temperature oxidation to conduct desulfonation, and in some instances, by separating reaction byproducts such as modified sugar products of reducing sugars and inorganic matter and by performing salt-forming reactions. The partially-desulfonated lignosulfonic acids and their salts are not necessarily limited to the above-obtained ones. Those obtained by conducting the heat-treatment and desulfonation at a lower pH can also be used.

As specific examples of additives useful in the practice of this invention, the following commercial products may be mentioned by way of example in addition to those obtained in Synthesis Examples which will be described later in this specification.

PARTIALLY-DESULFONATED SODIUM LIGNOSULFONATES

"VANILLEX HW" (trade name; product of Sanyo-Kokusaku Pulp Co., Ltd.)

"VANILLEX RN" (trade name; product of Sanyo-Kokusaku Pulp Co., Ltd.)

"Marsperse CB" (trade name; product of Marathon Inc.)

The amount of the additive usable in CMS varies depending on the type and particle size distribution of coal, etc. In general, it may be used in an range of 0.005–5 wt. %, preferably, 0.01–2 wt. % based on the whole weight of the fuel dispersion. Any amounts smaller than 0.005 wt. % are not suitable, because the additive cannot bring about any sufficient fluidity-improving effects. On the other hand, any amounts greater than 5 wt. % are not only disadvantageous economically but also conversely impair the fluidity and cannot provide any CMS having excellent quality. It is therefore not preferred to add the additive in any amounts outside the above-specified range.

It is also possible to use other viscosity reductants, for example, salts of homo- or co-polymers of unsaturated acids such as acrylic acid, salts of fatty acids such as citric acid, sulfonates of polymers of unsaturated aromatic compounds, anionic surfactants such as salts of formaldehyde condensation products of naphthalene-sulfonic acid and petroleum sulfonic acid, and ionic compounds such as amines, condensed phosphoric acid salts, silicic acid salts and carbonic acid salts; stabilizers, for example, alkylene oxide addition products obtained by using compounds with at least one active hydrogen per molecule, such as carboxylic acids, alcohols, amines, polypropylene glycol and compounds containing phenolic hydroxyl groups, and having an intramolecular ethylene oxide content of 80 wt. % or higher and a number average molecular weight of 1,000–100,000; ampholytic surfactants such as sulfuric acid esters and phosphoric acid esters of such non-ionic surfactants and N,N,N-distearyl-methylammonium-betaine; inorganic substances such as superfine silica, carbon black and bentonite; etc.

The above-described additives may be used neat. In order to allow them to function effectively, it is however preferred to use them in a form dissolved beforehand in a solvent, for example, water, a lower alcohol, acetone, toluene or a mixture thereof. They may be added, for example, upon grinding coal, upon mixing ground coal with methanol, or after mixing the ground coal with methanol. The effects of the present invention can be equally achieved no matter when they are added.

The methanol usable for the production of CMS of this invention need not be purified methanol. The methanol may contain certain impurities admixed in the course of its production and may also contain one or more lower alcohols having 1–4 carbon atoms. Further, coal and methanol are separated from each other at the time of use of CMS and the recovered methanol can then be reutilized. Since the inclusion of water in a suitable amount gives preferable influence to the quality of CMS as mentioned above, water-containing methanol can also be used. Starting coal material may be used without its drying. Wet coal obtained by removing water from coal transported in the form of CWS may also be used as is. This is particularly convenient from the practical viewpoint.

EXAMPLES

The CMS of this invention will hereinafter be described specifically by the following Examples. It should however be borne in mind that the CMS of this invention is not necessarily limited to or by the following Examples.

MEASURING METHODS OF PHYSICAL PROPERTIES

Individual physical properties of CMSs in the following Examples were measured by the following methods respectively.

(1) Particle size distribution:

JIS standard sieves were used. Particles down to 44 μm were measured by the wet sieving method which used methanol. Particles smaller than 44 μm were measured by the centrifugal-sedimentation light transmission method.

(2) Viscosity:

Using a double-cylindered rotation viscometer (Model: "Rotor MVII", manufactured by Haake Inc.), each viscosity was measured at a measurement temperature of 20° C. and a shear-viscosity function of 20 $sec^{-1}$.

(3) Stability:

Each CMS sample was placed in a 200-ml graduated cylinder. After allowing it to stand for 60 days or subjecting it to a shaking treatment on a shake table for a period equivalent to 60 day standstill, its stability was evaluated by the rod penetration test. In the rod penetration, a glass rod of 6 mm across and 520 mm high (weight: 37 g) was caused to drop from the liquid level of the CMS sample. When the rod stopped, its height from the bottom was measured as a compact layer. The rod was thereafter pushed gently by fingers. Here, the height of the rod from the bottom was measured as a lower compact layer. Measurement results were evaluated in accordance with the following 4-stage ranking system:

| | |
|---|---|
| ◎ | Compact layer not formed (instantaneous drop of rod to the bottom). |
| ○ | Compact layer formed; lower compact layer: 0%. |
| Δ | Compact layer formed; lower compact layer: less than 5%. |
| X | Compact layer formed; lower compact layer: 5% or more. |

The "refluidizable maximum standstill period of 2 months or longer", which is the target value of CMS of this invention, corresponds to the rankings○ ◎in the above ranking system.

(4) Combustibility:

By using a small combustion-testing furnace having an inner diameter of 1.5 m and a length of 4.5 m, each burning test was conducted under such conditions that the oxygen concentration reached about 2% in the flue gas. The combustion efficiency was calculated in accordance with the following equation.

$$\text{Combustion efficiency} = 100 \times \left(1 - \frac{L_c + L_i}{B \times He}\right)\%$$

where, $L_c$: Loss by unburnt carbon in dust at the outlet of the furnace (Kcal/hr)

$L_i$: Loss by incomplete combustion (Kcal/hr)

B: Amount burnt (kg/hr)

He: Lower calorific value (Kcal/hr)

EXAMPLE 1

By using coal samples from various coal fields shown in Table 1, the relationship between the particle size of coal particles and coal concentration Y in CMS and the slurry properties of the resultant CMS, namely, the relationship between the particle size and the storage stability and combustion efficiency was primarily investigated.

In the experiment, the coal samples were separately ground by means of a dry grinder, i.e., a hammer crusher, followed by addition of methanol to give CMS compositions given respectively in Table 1. The resultant coal-methanol mixtures were then subjected to wet grinding so as to achieve a desired particle size distribution. Additional methanol was added to adjust their concentrations, thereby obtaining CMS samples shown in Table 1. After allowing those CMS samples to stand for 60 days, their stability were individually evaluated in accordance with the degrees of formation of compact layers. Besides, their viscosities and combustion efficiencies were also measured. These results are summarized in Table 1. In this experiment, the water contents of the CMS samples were originated principally from the inherent moisture contained in the respective starting coal samples. In Table 1, the abbreviations are used for the coal samples:

| Abbreviation | Coal sample |
|---|---|
| Lignite | Canadian sub-bituminous coal |
| Coal K | Indonesian sub-bituminous coal |
| Coal M | U.S. sub-bituminous coal |
| Coal C | Canadian bituminous coal (1) |
| Coal Q | Australian bituminous coal |
| Coal D | Chinese bituminous coal |
| Coal A | Canadian bituminous coal (2) |

TABLE 1

| Experiment No. | Relevance | Coal used: Abbreviation | Coal used: Coalification degree (C %) | Coal used: Y | CMS composition (wt. %): Coal | CMS composition (wt. %): Methanol | CMS composition (wt. %): Moisture: Inherent | CMS composition (wt. %): Moisture: Others |
|---|---|---|---|---|---|---|---|---|
| 1 | Invention | Lignite | 73.8 | 58.7–39.8 | 55.0 | 36.1 | 8.9 | 0 |
| 2 | Experiment | Coal M | 76.7 | 61.6–42.7 | 45.0 | 49.7 | 6.3 | 0 |
| 3 | | Coal C | 78.5 | 63.4–44.5 | 60.0 | 36.2 | 3.8 | 0 |
| 4 | | Coal Q | 82.5 | 67.4–48.5 | 57.0 | 39.6 | 3.4 | 0 |
| 5 | | Coal D | 83.9 | 68.8–49.9 | 65.0 | 32.3 | 2.7 | 0 |
| 6 | | Coal A | 88.7 | 73.6–54.7 | 68.0 | 30.6 | 1.4 | 0 |
| 7 | | Coal C | 78.5 | 63.4–44.5 | 51.7 | 45.1 | 3.2 | 0 |
| 8 | Comparative | Coal M | 76.7 | 61.6–42.7 | 44.9 | 49.7 | 6.3 | 0 |
| 9 | Experiment | Coal M | 76.7 | 61.6–42.7 | 50.6 | 44.1 | 5.3 | 0 |
| 10 | | Coal C | 78.5 | 63.4–44.5 | 60.0 | 36.2 | 3.8 | 0 |

| Experiment No. | Relevance | Particle size distribution: Max. particle size (μm) | Particle size distribution: <74 μm (wt. %) | Particle size distribution: <10 μm (wt. %) | Particle size distribution: <3 μm (wt. %) | Properties of slurry: Viscosity (cps) | Properties of slurry: Storage* stability | Properties of slurry: Combustion efficiency(%) |
|---|---|---|---|---|---|---|---|---|
| 1 | Invention | 1100 | 53.0 | 21.0 | 7.5 | 900 | | 29.8 |
| 2 | Experiment | 1200 | 53.0 | 18.2 | 7.0 | 165 | | 29.8 |
| 3 | | 1000 | 55.0 | 18.0 | 5.0 | 880 | | 29.8 |
| 4 | | 980 | 45.5 | 16.3 | 3.5 | 500 | | 29.8 |
| 5 | | 950 | 53.2 | 16.1 | 5.5 | 900 | | 29.8 |
| 6 | | 950 | 55.0 | 16.0 | 2.5 | 400 | | 29.8 |
| 7 | | 1000 | 40 | 14.0 | 7.0 | 150 | | 29.8 |
| 8 | Comparative | 700 | 70.0 | 19.0 | 6.0 | 1740 | | — |
| 9 | Experiment | 700 | 55.0 | 8.5 | 2.5 | 660 | Δ | — |
| 10 | | 600 | 54.0 | 35.0 | 21.0 | 4000 | | — |

*Determined after left over for 60 days.

EXAMPLE 2

The relationship between the water content of CMS, especially, the amount of additional water other than the inherent moisture in coal and CMS properties was investigated. Following the same grinding procedure as that employed in Example 1, Canadian bituminous coal and Canadian sub-bituminous coal were separately ground to give a maximum particle size of 1,100 μm, 45–47 wt. % of 74 μm and smaller particles, 18–20 wt. % of 10 μm and smaller particles and 8.0–8.5 wt. % of 3 μm and smaller particles. CMS samples were then prepared from the thus-ground coal samples in the same manner as in Example 1. In this experiment, the water content of each CMS sample was adjusted by suitably incorporating additional water in addition to the inherent moisture in its corresponding starting coal sample when the coal sample was dry-ground. In this experiment, the standstill period after the preparation of the CMS samples was set for 60 days.

TABLE 2

| Experiment No. | 1 | 2 | 3 | 4 | 5 | 6 |
|---|---|---|---|---|---|---|
| Type of coal | Canadian bituminous coal | | | Canadian sub-bituminous coal | | |
| Concentration of coal (wt. %) | 61.0 | 59.7 | 61.2 | 55.4 | 55.5 | 55.7 |
| Concentration of water (wt. %) | | | | | | |
| Inherent moisture | 3.8 | 3.7 | 3.8 | 8.9 | 9.0 | 9.0 |
| Added water | 0 | 6.3 | 15.6 | 0 | 2.1 | 13.2 |
| Concentration of methanol (wt. %) | 35.2 | 30.7 | 19.4 | 35.7 | 33.4 | 22.1 |
| Viscosity (cps) | 898 | 667 | 610 | 968 | 951 | 855 |
| Stability evaluated | | | | | | |
| Combustion efficiency (%) | ≧98 | ≧98 | ≧98 | ≧98 | ≧98 | ≧98 |

EXAMPLE 3

Influence of the timing of water addition upon production of CMS to the viscosity of CMS was investigated.

After drying Canadian bituminous coal in air, it was ground at 2,800 rpm for 17 minutes by a Henschel mixer until coal particles under 200-mesh sieve amount to about 50%. Coarse particles were removed. The thus-ground coal particles had a maximum particle size of 1,050 μm and contained 47.0 wt. % of 74 μm and smaller particles, 19 wt. % of 10 μm and smaller particles and 8 wt. % of 3 μm and smaller particles.

In accordance with each of the following production procedures, methanol and water were added to the ground coal (water content: 3.5% . . . inherent moisture) and the resultant mixture was stirred. The viscosities of the resultant CMS samples, the coal concentrations of which ranged from 50 wt. % to 60 wt. %, were measured. Measurement results are given in Table 3 By the way, the stirring was effected at 400 rpm in a paddle agitator.

Production Procedure 1:

A prescribed amount of methanol was added to each ground coal and the resultant mixture was stirred for 10 minutes. After allowing the mixture to stand for 20 days, a prescribed amount of water was added and the resultant mixture was stirred for 20 minutes. The mixture was then allowed to stand for additional 20 days.

Production Procedure 2:

A prescribed amount of methanol was added in its entirety to each ground coal, and the resultant mixture was stirred for 20 minutes and then allowed to stand for 40 days.

Production Procedure 3:

A mixture of water and methanol, each in a prescribed amount, was added to each ground coal. The resultant mixture was stirred for 20 minutes and then allowed to stand for 40 days.

Production Procedure 4:

After adding a prescribed amount of water to each ground coal and then stirring the resultant mixture for 10 minutes, a prescribed amount of methanol was added and the resulting mixture was stirred for 10 minutes. It was thereafter allowed to stand for 20 days.

TABLE 3

| Experiment No. | 1 | 2 | 3 |
|---|---|---|---|
| Coal concentration (wt. %) | 60 | 55 | 50 |
| Methanol concentration (wt. %) | 20 | 22.5 | 25 |
| Water concentration (wt. %) | | | |
| Inherent moisture | 3.8 | 3.4 | 3.1 |
| Added water | 16.2 | 19.6 | 21.9 |
| Viscosity (cps) | | | |
| Procedure 1 | 1100 | 300 | 120 |
| Procedure 2 | 900 | 220 | 60 |
| Procedure 3 | 550 | 180 | 80 |
| Procedure 4 | 500 | 170 | 70 |

Synthesis Example 1:

Oxygen was blown under pressure for 1.5 hours at 170°-200° C. into a liquid mixture which consisted of 236.6 g of a sodium lignosulfonate solution [trade name: "SANX 252"; product of Sanyo-Kokusaku Pulp Co., Ltd.; concentration: 43 wt. %; the degree of sulfonation of the sodium lignosulfonate: 0.46 equivalent (in terms of phenylpropane unit)]and 50.0 g of caustic soda, thereby subjecting the sodium lignosulfonate solution to an oxidation treatment. Sulfuric acid was then added to the resultant liquid mixture to adjust its pH to 2.5, so that the thus-desulfonated lignosulfonic acid was caused to precipitated to obtain a partially-desulfonated lignosulfonic acid (A-1). The degree of its sulfonation was 0.06 equivalent in terms of phenylpropane unit as measured in accordance with JISK 3362-1978 and the barium sulfate weight method. The pH of the partially desulfonated lignosulfonic acid (A-1) was lowered to pH 7.5 with caustic soda, thereby obtaining another partially-desulfonated lignosulfonic acid (A-2) the purity of which was 92%.

Synthesis Example 2:

After adding a40% caustic soda solution to the sodium lignosulfonatesolution [trade name: "SANX 252"; product of Sanyo-Kokusaku Pulp Co., Ltd.; concentration: 43 wt. %; the degree of sulfonation of the sodium lignosulfonate: 0.46 equivalent (in terms of phenylpropane unit)] to adjust its pH to 12, air was brown under pressure at 150°-180° C. for 60 minutes so as to subject the sodium lignosulfonate solution to an oxidation treatment. Sulfuric acid was then added to the resultant mixture to lower its pH to 2.5, thereby causing the thus-desulfonated lignosulfonic acid to precipitate. A further partially-desulfonated lignosulfonic acid (A-3) was thus obtained. The degree of its sulfonation was 0.23 equivalent in terms of phenylpropane unit as measured in accordance with JISK 3362-1978 and the barium sulfate weight method. The pH of the partially desulfonated lignosulfonic acid (A-3) was lowered to pH 9 with caustic soda, thereby obtaining a still further partially-desulfonated lignosulfonic acid (A-4) the purity of which was 95%.

Synthesis Example 3:

After adding a 40% caustic soda solution to the sodium lignosulfonate solution [trade name: "SANX 252"; product of Sanyo-Kokusaku Pulp Co., Ltd.; concentration: 43 wt. %; the degree of sulfonation of the sodium lignosulfonate: 0.46 equivalent (in terms of phenylpropane unit)]to adjust its pH to 12, air was brown under pressure at 150°-180° C. for 30 minutes so as to subject the sodium lignosulfonate solution to an oxidation treatment. Sulfuric acid was then added to the resultant mixture to lower its pH to 2.5, thereby causing the thus-desulfonated lignosulfonic acid to precipitate. A still further partially-desulfonated lignosulfonic acid (A-5) was thus obtained. The degree of its sulfonation was 0.32 equivalent in terms of phenylpropane unit as measured in accordance with JISK 3362-1978 and the barium sulfate weight method. The pH of the partially desulfonated lignosulfonic acid (A-5) was lowered to pH 8 with caustic soda, thereby obtaining a still further partially-desulfonated lignosulfonic acid (A-6) the purity of which was 92%.

EXAMPLE 4

Upon addition of methanol in CMS Production Procedure 4 under Experiment No. 1 of Example 3, the partially-desulfonated lignsulfonic acid (A-2) synthesized in Synthesis Example 1 was added to CMS samples in such amounts that the concentrations of the partially-desulfonated lignosulfonic acid (A-2) were 0.05 wt. % and 0.5 wt. % respectively. The viscosities of the thus-produced CMS samples were then measured in the same manner as in Example 3.

As a result, it was confirmed that the viscosity of 500 cps before the addition of the partially-desulfonated lignosulfonic acid (A-2) was lowered to 183 cps and 126 cps respectively.

EVALUATION OF THE INVENTION

In the experiments described in Example 1, the viscosities of the CMS samples obtained at coal concentrations close to the greatest one of the Y values of the used coals were either close to or higher than 1,000 cps. This indicates that such coal concentrations are close to the upper limit of coal concentration for the transportation of slurries. It has also been found that CMS having preferable slurry properties cannot be obtained if the particle size range of coal particles specified in the present invention, namely, the maximum particle size and the respective proportions of 74 μm and smaller particles, 10 μm and smaller particles and 3 μm and smaller particles do not fall within their corresponding ranges specified in the present invention.

From the experiments described in Example 2, it has also been found that CMS added with a suitable amount of water in addition to the inherent moisture of coal has a lower slurry viscosity and better stability compared with CMS containing water originated only from the inherent moisture of coal.

From the experiments described in Example 3, it has also been found that the timing of addition of water upon production of CMS gives important influence to the viscosity of the resultant CMS. For maintaining the viscosity of resulting CMS at a lower level, it is effective to bring coal particles into contact with water prior to their contact with methanol and then to bring the resultant coal-water mixture into contact with methanol. It has also been revealed that this effect becomes more remarkabl as the coal concentration of CMS increases.

From the experiments described in Example 4, it has been appreciated that an addition of a partiallydesulfonateed lignosulfonic acid is effective for lowering the viscosity of a slurry.

Having now fully described the invention, it will be apparent to one of ordinary skill in the art that many changes and modifications can be made thereto without departing from the spirit or scope of the invention as set forth herein.

We claim:

1. In a coal-methanol slurry of coal particles and methanol as principal components, the improvement comprising:

a slurry comprising from 42.7–73.6 wt. % coal particles in a liquid medium comprising methanol and water and from 0.005–5 wt. % of at least one compound selected from the group consisting of partially-desulfonated lignosulfonic acids and salts thereof, based on the weight of the coal-methanol slurry, wherein the total water content of the slurry ranges up to 30 wt. %, which water content includes 2–25 wt. % of water added to the slurry in addition to the inherent moisture of the coal particles; said coal particles having a maximum particle size not greater than 1500 μm and a cumulative particle size distribution of 30–65 wt. % of 74 μm and smaller particles, 10–25 wt. % of 10 μm and smaller particles and 5–15 wt. % of 3 μm and smaller particles, the concentration of the coal particles being within a range which satisfies the relationship:

$$X-34.0 \leqq Y \leqq X-15.1$$

wherein X designates the degree of coalification expressed in terms of wt. % carbon in the coal particles and Y denotes the concentration (wt. %) of the coal particles in the slurry.

2. The coal-methanol slurry as claimed in claim 1, wherein the salts of lignosulfonic acid and the salts of the partially-desulfonated lignosulfonic acids contain individually a monovalent, divalent or trivalent metal, ammonium or amine cation as a salt forming cation.

3. The coal-methanol slurry as claimed in claim 1, wherein the viscosity of the slurry ranges from 50 cps to 1,000 cps as measured by a double-cylindered rotation viscometer.

4. The coal-methanol slurry as claimed in claim 1 wherein said coal is a ground anthracite coal, bituminous coal or a lignite.

5. A process for producing a coal-methanol slurry, which comprises:

(a) dry- or wet-grinding coal to coal particles having a maximum particle size not greater than 1,500 μm and a cumulative particle size distribution of 30–65 wt. % of 74 um and smaller particles, 10–25 wt. % of 10 μm and smaller particles and 5–15 wt. % of 3 μm and smaller particles;

(b) adding, to the coal particles, at least a portion of water in an amount sufficient to achieve a total water content of the inherent moisture of the coal plus at least 2 wt. % in the coal-methanol slurry to be obtained at the end of the process, and mixing the resultant coal-water mixture;

(c) adding methanol and any remaining portion of the water to the thus-obtained coal-water mixture so as to control the total water content in the slurry below 30 wt. % and within a range of the inherent moisture of the coal plus 2–25.0 wt. %;

(d) adding 0.005–5 wt. % of at least one compound selected from the group consisting of partially-desulfonated lignosulfonic acids and salts thereof, and mixing the resultant coal-water mixture;

(e) causing the concentration of the coal particles in the coal methanol slurry to satisfy the following equation (a):

$$X-34.0 \leqq Y \leqq X-15.1 \qquad \text{(a)}$$

wherein X means the degree of coalification expressed in terms of wt. % of carbon in the coal particles and Y denotes the concentration (wt. %) of the coal particles in the slurry; and (f) simultaneously forming a coal-methanol slurry comprising from 42.7–73.6 wt. % coal particles in a liquid medium comprising methanol and water, and from 0.005–5 wt. % of at least one compound selected from the group consisting of partially-desulfonated lignosulfonic acids and salts thereof, based on the weight of the coal-methanol slurry.

6. The process as claimed in claim 5, wherein tne methanol is added and mixed after the addition and mixing of the whole water in the step (b).

* * * * *